United States Patent [19]

Kono et al.

[11] Patent Number: 4,669,298

[45] Date of Patent: Jun. 2, 1987

[54] PRESS

[75] Inventors: Shigeyoshi Kono, Zama; Yoshimitsu Tsutsui, Hadano; Fumio Koshiji; Tomohiko Sawayanagi, both of Isehara, all of Japan

[73] Assignee: Amada Company, Limited, Isehara, Japan

[21] Appl. No.: 912,210

[22] Filed: Sep. 25, 1986

Related U.S. Application Data

[63] Continuation of Ser. No. 827,188, Feb. 6, 1986, abandoned, which is a continuation of Ser. No. 527,272, Aug. 29, 1983, abandoned.

[30] Foreign Application Priority Data

Aug. 30, 1982 [JP] Japan ..... 57-149216
Jul. 8, 1983 [JP] Japan ..... 58-123426

[51] Int. Cl.[4] ..... B21J 7/28

[52] U.S. Cl. ..... 72/453.13; 72/348; 72/351; 72/358; 267/119; 100/299; 92/85 B

[58] Field of Search ..... 72/20, 453, 13, 465, 72/354, 359, 358, 348, 349, 336, 339, 119; 267/119, 130; 188/272, 299, 311; 92/11, 12, 85 B

[56] References Cited

U.S. PATENT DOCUMENTS

| | | | |
|---|---|---|---|
| 2,233,164 | 2/1941 | Glasner | 267/119 |
| 2,269,778 | 1/1942 | Merrill | 72/20 |
| 2,294,451 | 9/1942 | Ernst | 72/20 |
| 2,300,162 | 10/1942 | Maude | 72/20 |
| 2,407,855 | 9/1946 | Stephens | 72/20 |
| 3,124,340 | 3/1964 | Williamson | 267/119 |
| 3,405,546 | 10/1968 | Hoffman et al. | 72/348 |
| 3,435,653 | 4/1969 | Scaletta et al. | 72/336 |
| 3,653,301 | 4/1972 | Clendenin et al. | 267/119 |
| 4,056,965 | 11/1977 | Heiser | 267/119 |
| 4,309,888 | 1/1982 | Miller et al. | 72/334 |

*Primary Examiner*—Robert L. Spruill
*Assistant Examiner*—David B. Jones
*Attorney, Agent, or Firm*—Armstrong, Nikaido, Marmelstein & Kubovcik

[57] ABSTRACT

A press comprises a bed affixed to a frame, a slide vertically movably provided above the bed, a lower cushion mounted to the underside of the bed and having chambers, an upper cushion mounted to the slide and having chambers, a pneumatic hydraulic control circuit for a pressure source of each of the cushions, and a control for controlling individually the pressure within the chambers, wherein a complicated workpiece can be formed in one stroke of the slide.

4 Claims, 9 Drawing Figures

PRESS

This application is a continuation, of application Ser. No. 827,188 filed Feb. 6, 1986, now abandoned which is a continuation of Ser. No. 527,272 filed Aug. 29, 1983, now abandoned.

BACKGROUND OF THE INVENTION

1. Field of the Invention

The present invention relates to a press which has a vertically movable slide for acting on tools or dies to form metallic materials into a variety of shapes. More particularly, the present invention pertains to a press which is capable of performing a variety of processes in one stroke of the slide.

2. Description of the Prior Art

In metal forming, it is often desired to perform a variety of processes such as drawing, trimming, and piercing to form a workpiece or material into a varied shape such as a product shaped like a silk hat.

Heretofore, it has been customary that a workpiece is continuously fed into several presses each having a set of dies for forming a peculiar shape in order to form a varied shape. For instance, a workpiece is drawn by a first press and next trimmed by a second press and then it is pierced by a third press to be formed into a varied shape.

Accordingly, it has been disadvantageous that there is a need for a number of presses and transferring apparatus or robots for feeding workpieces in order to make products of a varied shape. Therefore, it has been also disadvantageous that a big amount of cost and a wide space are necessary for such a number of presses.

In order to solve this problem, it is proposed that one set of dies is designed to perform a variety of forming processes on one press and in one stroke of the slide of the press. However, it is extremely difficult to make such a set of dies, since it is necessary that various elements move differently in each forming process in a manner such that some of them are stopped from moving while the others are being moved. Also, it is inevitable that dies for performing a variety of forming processes are very complicated and accordingly they are very costly and expensive.

SUMMARY OF THE INVENTION

It is a primary object of the present invention to provide a press which is capable of performing a variety of forming processes in one stroke of the slide thereof.

It is an object of the present invention to provide a press which has cushion means to enable dies to perform a variety of forming processes in one stroke of the slide thereof.

It is an object of the present invention to provide a press having cushion means in which hydraulic pressure is controlled by a pneumatic hydraulic control circuit to enable dies to perform a variety of forming processes in one stroke of the slide.

It, is a further object of the present invention to provide a press having cushion means which are supplied with hydraulic fluid under pressure by a pneumatic hydraulic control circuit to enable dies to perform a variety of forming processes in one stroke of the slide.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENT

Figure 1:
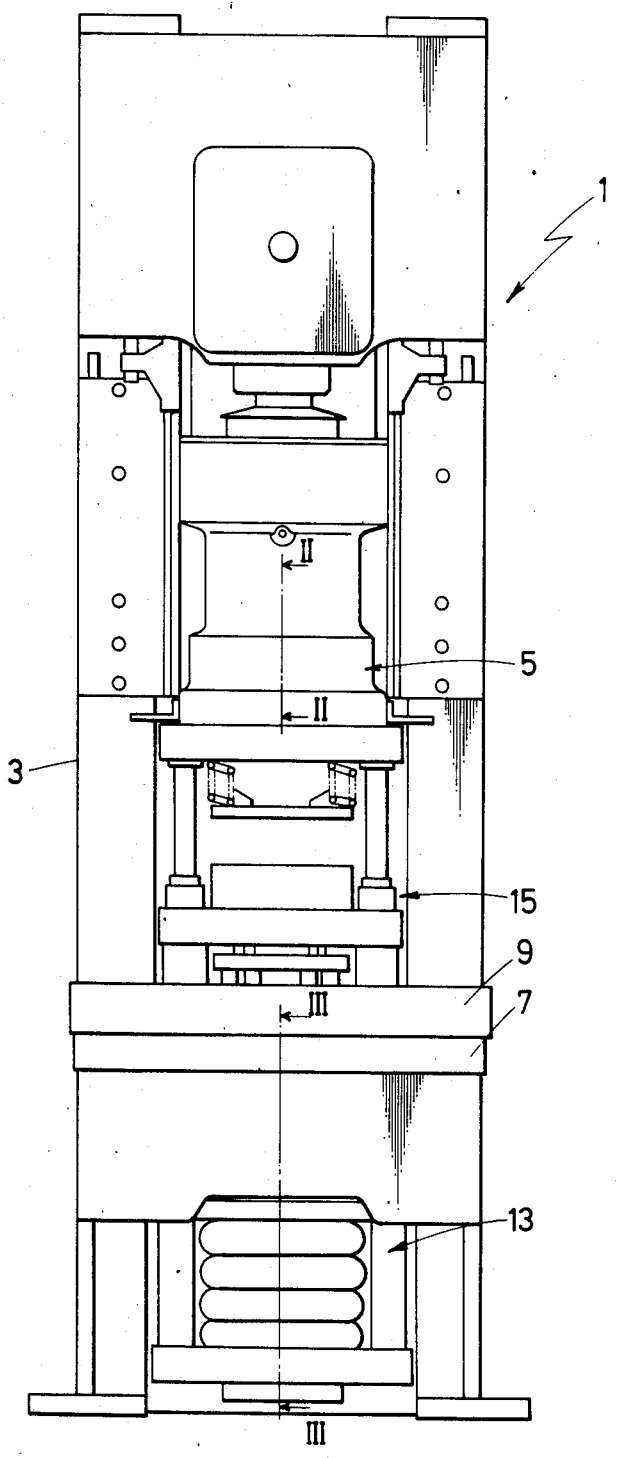
FIG. 1 is a front elevational view of a press according to the present invention.

Referring to FIG. 1, there is shown a press generally designated by numeral 1 which is conventional in that it is constructed of a frame 3 and has a slide 5 vertically movably provided at the front portion of the frame 3. As is also conventional, a bed 7 is fixedly provided at the front lower portion, and a bolster 9 is horizontally and fixedly mounted on the bed 7 just under the slide 5. Thus, the slide 5 is so arranged as to be vertically moved along the front portion of the frame 3 toward and away from the bolster 9 for operations in a conventional manner by a slide driving means such as a crank shaft or hydraulic motor.

Still referring to FIG. 1, an upper cushion means 11 (FIG. 2) is mounted on the underside of the slide 5 of the press 1, and a lower cushion means 13 is mounted on the underside of the bed 7 of the press 1 in a fixed relationship therewith. The upper and lower cushion means 11 and 13 are connected to a pneumatic hydraulic control circuit, and they will be described in great detail hereinafter. Also, a die set 15 is detachably mounted on the bolster 9 in such a manner as to be located just beneath the upper cushion means 11 and just above the lower cushion means 13. In this arrangement, the die set 15 will work with the aid of the upper and lower cushion means 11 and 13 to form a workpiece therein to a desired contour when the slide 5 is lowered together with the upper cushion means 11.

Figure 2:
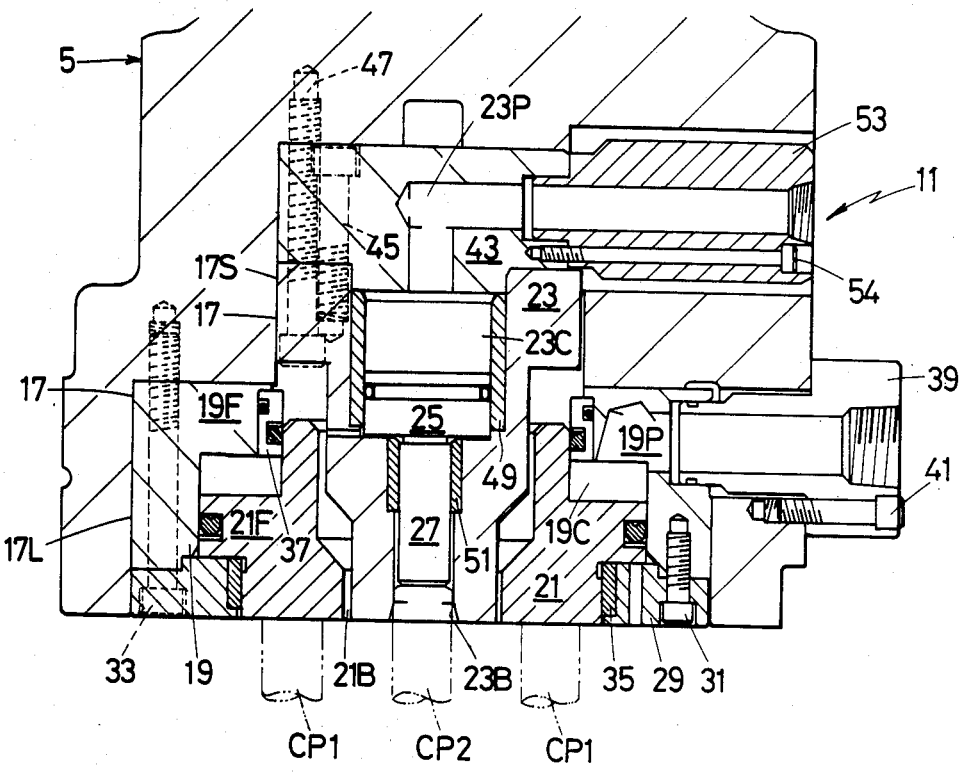
FIG. 2 is an enlarged vertical sectional view taken along the line II—II of FIG. 1.

Referring to FIG. 2, the upper cushion means 11 is mounted in a stepped bore 17 which is formed at the bottom of the slide 5 in such a manner as to downwardly open and have a lower larger portion 17L of a larger diameter and an upper smaller portion 17S of a smaller diameter. The upper cushion means 11 comprises a ring-like first hydraulic cylinder 19 in which a ring-like first piston 21 having a circular bore 21B is vertically slidably enclosed, and it comprises also a sleeve-like second hydraulic cylinder 23 in which a second piston 25 having a piston rod 27 is vertically slidably enclosed. The first hydraulic cylinder 19 is vertically fixed in the larger portion 17L of the stepped bore 17, and the second hydraulic cylinder 23 is vertically fixed in the smaller portion 17S of the same.

The first hydraulic cylinder 19 of the upper cushion means 11 is formed at its upper end with an inner flange 19F, and it is formed also at its upper portion with a port 19P for hydraulic fluid. The first hydraulic cylinder 19 is provided at its lower end with a ring member 29 like an inner flange in a manner such that its underside is substantially flush with the lower end of the slide 5. The ring member 29 is fixed to the first hydraulic cylinder 19 by a plurality of bolts 31, and the first hydraulic cylinder 19 is fixed to the slide 5 by a pluraliy of bolts 33 together with the ring member 29.

The ring-like first piston 21 of the first hydraulic cylinder 19 is formed to be smaller in diameter at its upper and lower portions to have a median flange-like portion 21F so that hydraulic fluid can be applied to the upper surface of the flange-like portion 21F. Also, the first piston 21 is so designed that its annular bottom is horizontally wide enough to receive a plurality of cushion pins CP1 provided on the die set 15 as will be seen hereinafter. The first piston 21 of this design is disposed in a first hydraulic chamber 19C of the first hydraulic cylinder 19 in such a manner as to be vertically moved between the lower surface of the inner flange 19F thereof and the upper surface of the ring member 29. In order to guide the first piston 21 in the first hydraulic cylinder 19, an annular bushing 35 is fixed to the ring member 29, and also a seal ring 37 is provided at the inner periphery of the inner flange 19F of the first cylinder 19. Also, a joint 39 is connected by means of a plurality of bolts 41 to the port 19P of the first hydraulic cylinder 19 so as to supply and drain hydraulic fluid into and from the first hydraulic chamber 19C as will be described in great detail hereinafter. In this connection, the arrangement is such that the hydraulic fluid prevailing in the first hydraulic chamber 19C of the first hydraulic cylinder 19 is drained therefrom when a certain predetermined pressure is reached, as will be also described in great detail hereinafter.

In the above described arrangement, the first piston 21 of the upper cushion means 11 will be kept downwardly biased in the first hydraulic cylinder 19 when the hydraulic fluid from the joint 39 through the port 19P thereof is prevailing in the first hydraulic chamber 19C to act on the upper surface of the flange-like portion 21F of the first piston 21. Also, when the slide 5 is lowered, the first piston 21 will act to depress the cushion pins CP1 located therebeneath, as long as it is biased downwardly under a hydraulic pressure surpassing the reaction of the cushion pins CP1. However, as soon as the hydraulic fluid in the first hydraulic chamber 19C of the first hydraulic cylinder 19 is pressurized by the increasing reaction of the cushion pins CP1 to reach a predetermined pressure, the first piston 21 which is being lowered by the slide 5 together with the first hydraulic cylinder 19 will be stopped by the cushion pins CP1 from lowering. Also after the first piston 21 has been stopped by the cushion pins CP1 from lowering, the first hydraulic cylinder 19 will be further lowered by the slide 5 in a manner such that the first piston 21 is relatively upwardly moved in the first hydraulic cylinder 19.

As shown further in FIG. 2, the second hydraulic cylinder 23 of the upper cushion means 11 is formed at its lower central portion with a vertical cylindrical bore 23B in which the piston rod 27 of the second piston 25 is vertically slidably inserted. When the die set 15 is mounted on the bolster 9, a cushion pin CP2 is also vertically movably inserted in the cylindrical bore 23B of the second hydraulic cylinder 23, as will be seen hereinafter. The second hydraulic cylinder 23 is provided at its top with a cylinder cap 43 in which a L-shaped passage 23P is formed so that hydraulic fluid can be supplied into and drained from the second hydraulic cylinder 23. The cylinder cap 43 is fixed to the second hydraulic cylinder 23 by a plurality of bolts 45, and the second hydraulic cylinder 23 and the cylinder cap 43 are fixed together by a plurality of bolts 47 to the slide 5 in the smaller portion 17S of the stepped bore 17. The second hydraulic cylinder 23 is so disposed as to vertically extend downwardly into the bore 21B of the first piston 21 in the first hydraulic cylinder 19 to the level of the bottom of the slide 5. Also, the second piston 25 is vertically movably disposed in the second hydraulic cylinder 23 with its piston rod 27 vertically movably inserted in the cylindrical bore 23B thereof so as to make a second hydraulic chamber 23C beneath the cylinder cap 43. In order to guide the second piston 25 and the piston rod 27, bushings 49 and 51 are provided in the second cylinder 23 and the cylindrical bore 23B thereof. Also, a joint 53 is connected by means of a plurality of bolts 54 to the passage 23P formed in the cylinder cap 43 so as to supply and drain hydraulic fluid into and from the second hydraulic chamber 23C of the second hydraulic cylinder 23 as will be described in great detail hereinafter. In this connection, the arrangement is more or less the same as the first cylinder 19 in that the hydraulic fluid prevailing in the second hydraulic chamber 23C of the second hydraulic cylinder 23 is drained therefrom when a predetermined pressure is reached, as will be also described in great detail hereinafter.

In the above described arrangement, the second piston 25 of the upper cushion means 11 will be kept downwardly biased in the second hydraulic cylinder 23 when the hydraulic fluid from the joint 53 through the passage 23P thereof is prevailing in the second hydraulic chamber 23C. Also, when the slide 5 is lowered, the second piston 25 will act to depress by means of the piston rod 27 the cushion pin CP2 located in the cylindrical bore 23B of the second hydraulic cylinder 23, as far as it is biased downwardly under a pressure surpassing the reaction of the cushion pin CP2. However, as soon as the hydraulic fluid in the second hydraulic chamber 23C of the second hydraulic cylinder 23 is pressurized by the increasing reaction of the cushion pin CP2 to reach a predetermined pressure, the second piston 25 being lowered by the slide 5 together with the second hydraulic cylinder 23 will be stopped by the cushion pin CP2 from lowering. Also, after the second piston 25 has been stopped by the cushion pin CP2 from lowering, the second hydraulic cylinder 23 will be further lowered by the slide 5 in a manner such that the second piston 25 is relatively upwardly moved in the second hydraulic cylinder 23.

In this connection, a knockout pin could be placed in the cylindrical bore 23B of the second hydraulic cylinder 23 instead of the cushion pin CP2 so that it may remove blanks or scraps from a rkpiece. Also, it will be understood by those skilled in the art that the upper cushion means 11 could be used without the second hydraulic cylinder 23 and the related elements to perform a simpler forming operation.

Figure 3:
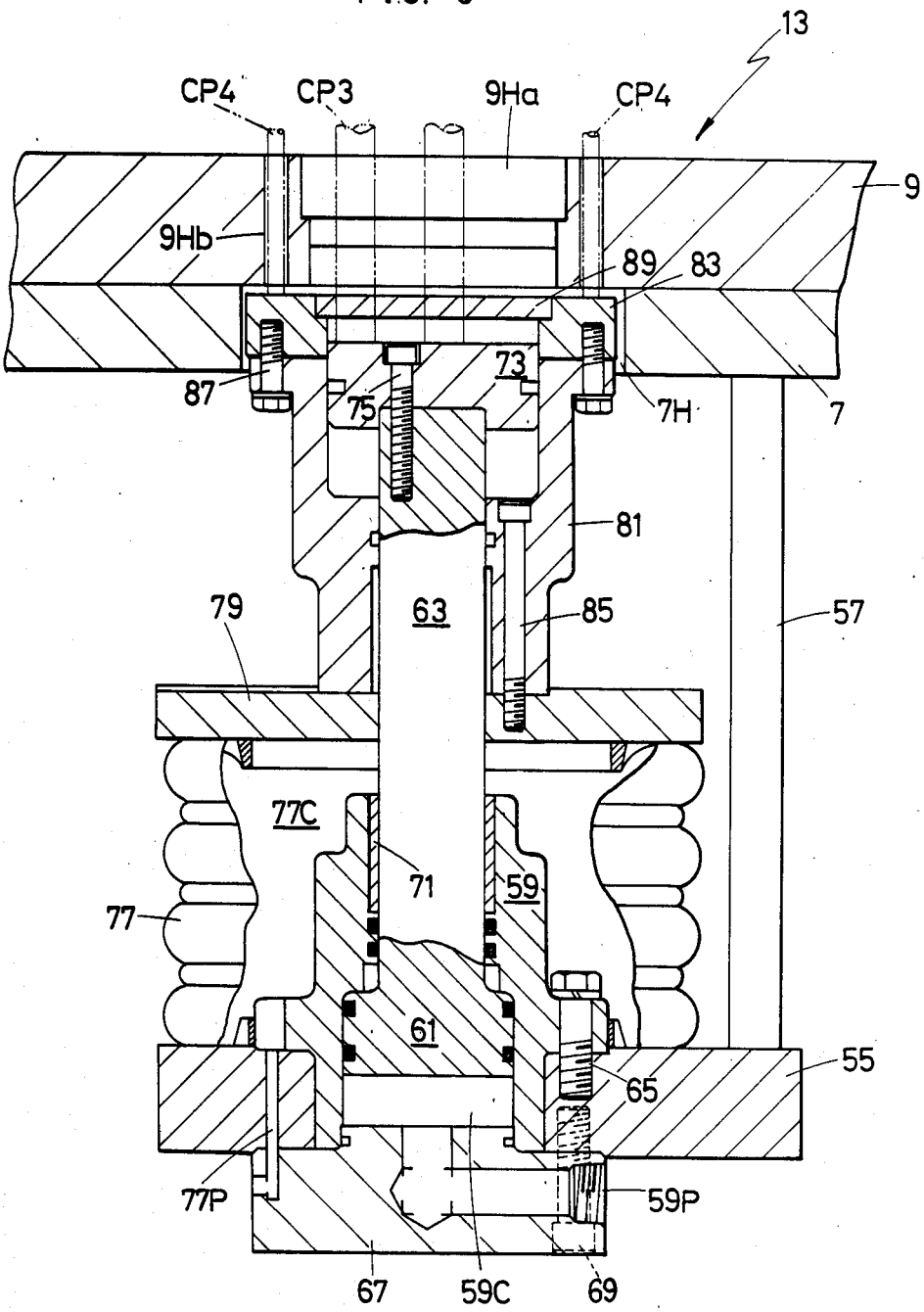
FIG. 3 is an enlarged vertical sectional view taken along the line III—III of FIG. 1.

Referring to FIG. 3, the lower cushion means 13 is held beneath the bed 7 by a holding plate 55 which is horizontally held by a plurality of holding arms 57 vertically fixed to the underside of the bed 7. More particularly, the lower cushion means 13 is disposed just beneath holes 7H and **9H*a* which are formed respectively through the bed 7 and the bolster 9, where the die set 15** is to be located.

The lower cushion means 13 comprises a third hydraulic cylinder 59 which is provided with a third piston 61 having a longish piston rod 63 and is fixed to the holding plate 55 by a plurality of bolts 65. The third hydraulic cylinder 59 is vertically mounted on the holding plate 55 in a manner such that the piston 61 is vertically movable therein with the piston rod 63 vertically upwardly extended therefrom. The third hydraulic cylinder 59 is provided at its lower end with a cylinder cap 67 to have a hydraulic chamber 59C beneath the third piston 61. The cylinder cap 67 is fixed to the third cylinder 59 by a plurality of bolts 69, and it is formed with a L-shaped hydraulic passage 59P so that hydraulic fluid can be supplied into and drained from the hydraulic chamber 59C therethrough. As will be described in great detail, the arrangement is such that the hydraulic fluid prevailing in the hydraulic chamber 59C is drained therefrom through the passage 59P when a predetermined pressure is reached. Also, in order to rigidly guide the longish piston rod 63 of the piston 61, the third hydraulic cylinder 59 is provided at its upper portion with a cylindrical bushing 71. The piston rod 63 is provided at its top end with a cushion pad 73 fixed thereto by a plurality of bolts 75 and a cushion pin or cushion pins CP3 which are connected the die set 15. Also, the piston rod 63 is so disposed as to move the cushion pad 73 toward and away from the hole 9H of the bolster 9 when the third piston 61 is moved in the hydraulic cylinder 59.

In the above described arrangement, the third piston of the lower cushion means 13 will be kept upwardly biased in the third hydraulic cylinder 59 to keep the cushion pad 73 coping with the cushion pins CP3 by means of the piston rod 63 when the hydraulic fluid is prevailing in the third hydraulic chamber 59C. However, as soon as the hydraulic fluid in the third hydraulic chamber 59C is pressurized to reach a predetermined pressure, part of the hydraulic fluid will be exhausted and the third piston 61 will be downwardly moved together with the piston rod 63 and the cushion pad 73 to cause the cushion pins CP3 to lower.

Referring also to FIG. 3, the lower cushion means 13 comprises further a bellows 77 which is secured onto the holding plate 55 in such a manner as to enclose or surround the third hydraulic cylinder 59 to have a pneumatic chamber 77C therearound. In order to supply and exhaust pneumatic fluid into and from the pneumatic chamber 77C of the bellows 77, there is provided a passage 77P which is formed through the holding plate 55. As will be described hereinafter, the arrangement is such that the pneumatic fluid is exhausted from the pneumatic chamber 77C of the bellows 77 when a certain predetermined pressure is reached. The bellows 77 is connected at its top end to a slide plate 79 to which a cylindrical holding member 81 holding a ring-like cushion pad 83 is integrally fixed by a plurality of bolts 85. The slide plate 79 is disposed on and around the piston rod 63 of the third hydraulic cylinder 59 so that it may be vertically moved or slid therealong when the bellows 77 is expanded and contracted. The cylindrical holding member 81 is disposed in such a manner as to surround the piston rod 63 and the cushion pad 73 so that it may be vertically slid therealong to carry the ring-like cushion pad 83 when the bellows 77 is expanded and contracted to move the slide plate 79. The ring-like cushion pad 83 is horizontally fixed to the top end of the cylindrical holding member 81 by a plurality of bolts 87 so that it may receive a cushion pin or pins CP4 which are connected to the die set 15 through holes **9H*b* formed through the bolster 9. Also, a cap member 89 is detachably horizontally placed on the ring-like cushion pad 83 so that it may receive additional cushion pins when the cushion pad 73 is not used to receive the cushion pins CP3. In the above described arrangement, the bellows 77 of the lower cushion means 13 will keep the slide plate 79 and the cylindrical holding member 81 upwardly biased to enable the ring-like cushion pad 83 to cope with the cushion pins CP4 when expanded by the pneumatic fluid in the pneumatic chamber 77C. However, as soon as the pneumatic fluid in the pneumatic chamber 77C is pressurized to reach a predetermined pressure and exhausted therefrom, the bellows 77 will be contracted to lower the ring-like cushion pad 83 together with the slide plate 79 and the cylindrical holding member 83** to allow the cushion pins CP4 to move downwardly.

Figure 4:
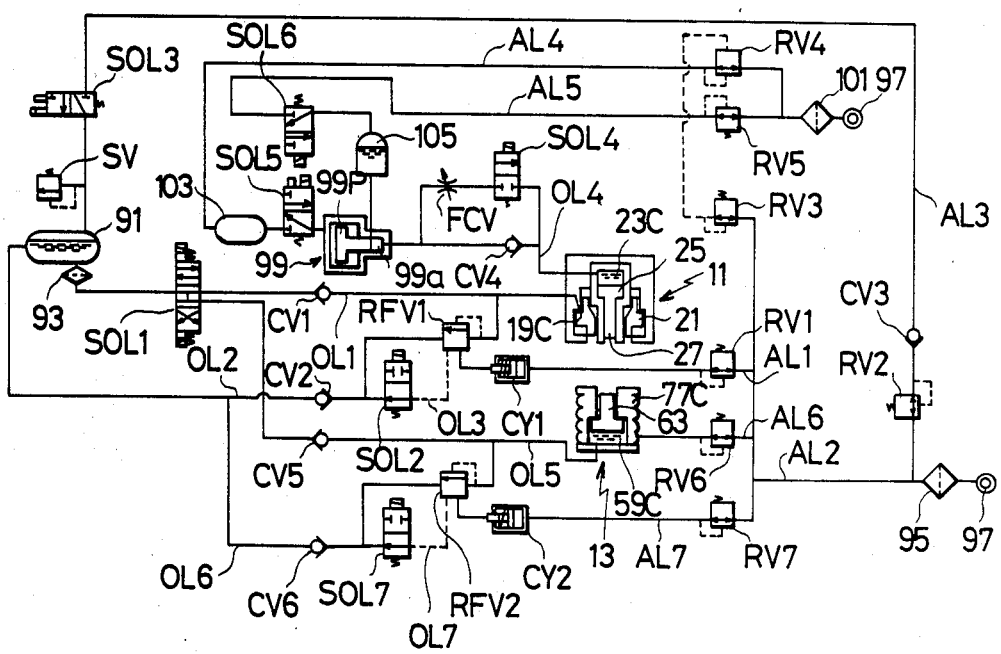
FIG. 4 is a schematic illustration of a pneumatic hydraulic control circuit of the present invention.

Referring now to FIG. 4, the pressure in the respective chambers of the upper cushion means 11 and the lower cushion means 13 is controlled by a pneumatic hydraulic control circuit. Namely, in order to supply pressurized oil to the first hydraulic chamber **19*c* of the upper cushion means 11, the first chamber 19*c* is connected through a first oil line OL1 to a pneumatically pressurized oil tank 91 which is in turn connected to and receives air from a air supply source 97 as detailed hereinafter. The first oil line OL1 is arranged with an oil filter 93, a four-port three-position first solenoid valve SOL1 and a first check valve CV1 successively, and normally, the pressurized oil can flow into the first chamber 19*c* from the oil tank 91. Thus, the first piston 21** of the upper cushion means is always biased downwardly.

In order to control the pressure inside the first chamber **19*c*, the first oil line is branched off in a drain oil line OL2 which is successively arranged with a pressure regulating first relief valve RFV 1 and a second check valve CV2, the latter being connected to the oil tank 91. The first relief valve RFV 1 can be controlled by a first control cylinder CY1 to regulate arbitrarily the upper limit of the pressure within the first chamber 19*c*. However, when a second solenoid valve SOL2 connected to a pilot line OL3 of the first relief valve RFV1 is opened, the first relief valve RFV1 can easily be opened, thus the pressure inside the first chamber 19*c*** will rapidly be decreased.

In order to set the pressure of the first relief valve RFV1 by controlling the first control cylinder CY1, the first control cylinder CY1 is connected to a first air line AL1 which is arranged with a pressure reducing valve RV1 for setting the pressure. The first air line AL1 is connected to a second air line AL2 which in turn is connected to the air supply source 97 through an air filter 95. Accordingly, the upper limit of the pressure inside the first chamber **19*c* of the upper cushion means 11** can be arbitrarily set by firstly controlling the first control cylinder CY1 through control of a first pressure reducing valve RV1 and then by properly controlling the first relief valve RFV1 through the first control cylinder CY1.

In order to apply pneumatic pressure to the oil tank 91, a third air line AL3 connected to the oil tank 91 is connected to the second air line AL2. The third air line AL3 is arranged with a second pressure reducing valve RV2, a third check valve CV3, a three port two position third solenoid valve SOL3 and a safety valve SV, successively. Thus, by energizing the solenoid valve SOL 3 as required, the oil tank 91 is always imposed with a required pressure, and as described previously, the first chamber 19*c* of the upper cushion means is always imposed with a hydraulic pressure.

Referring again to FIG. 4, in order to supply pressurized oil to the second chamber 23*c* of the upper cushion means, the second chamber 23*c* is connected to a pressure amplifying chamber 99*a* of a booster 99 through a fourth oil line OL4. The fourth oil line OL4 is arranged with a flow control valve FCV which is connected in series with a solenoid valve SOL4 for a shut-off valve, and a fourth check valve CV4 is arranged in parallel with the flow control valve FCV and the fourth solenoid valve SOL4. Thus, pressurized oil can be supplied to the second chamber 23*c* only when the fourth solenoid valve SOL4 is opened.

In order to control the booster 99, a fourth air line AL4 and a fifth air line AL5 are connected to the booster 99 respectively. Namely, the fourth air line AL4 is connected to the air supply source 97 through an air filter 101, and is arranged with a fourth pressure reducing valve RV4, an accumulator 103 and a fifth solenoid valve SOL5 for a shut-off valve successively. The fourth pressure reducing valve RV4 is controlled by a third pressure reducing valve RV3 connected to the second air line AL2. Also the fifth air line AL5 connected to an amplifying chamber 99*a* of the booster 99 is arranged with a fifth pressure reducing valve RV5, a sixth solenoid valve SOL6 for a shut-off valve and an oil replenishing tank 105 in series. Thus, when the sixth solenoid valve SOL6 is opened, oil within the replenishing tank 105 is furnished to the amplifying chamber 99*a* of the booster 99, and further, when the fourth and fifth solenoid valves SOL4 and SOL5 are open, a piston 99*p* within the booster 99 is activated, and pressurized oil within the amplifying chamber 99*a* is supplied to the second chamber 23*c* of the upper cushion means.

Referring further to FIG. 4, in order to control the pressure inside the pneumatic chamber 77*c* of the bellows 77 and the third hydraulic chamber 59*c* which are located in the lower cushion means 13, a sixth air line AL6 is connected to the pneumatic chamber 77*c* and a fifth oil line OL5 is connected to the third hydraulic chamber 59*c*. The sixth air line AL6 is connected to the second air line AL2 and is arranged with a sixth pressure reducing valve RV6. Thus, the pneumatic chamber 77*c* is always actuated by pneumatic pressure. Also, the fifth oil line OL5 is connected to the first solenoid valve SOL1 and is arranged with a fifth check valve CV5. The pressure within the fifth oil line OL5 and the third chamber 59*c* is controlled in a similar system as that for the first chamber 19*c* of the upper cushion means. Namely, a drain oil line OL6 branches off from the fifth oil line OL5, and is arranged with a second relief valve RFV 2 and a sixth check valve CV6, and a seventh solenoid valve SOL7 is arranged in a pilot line OL7 of a second relief valve RFV2. Further, a second control cylinder CY2 which controls the second relief valve RFV2 is connected to a seventh air line AL7 which in turn is connected to the second air line AL2, the seventh air line AL7 being arranged with a seventh pressure reducing valve RV7. Accordingly, the third chamber 59*c* of the lower cushion means can be set and controlled in a similar manner to be set forth with respect to the first chamber 19*c* of the upper cushion means.

Referring to FIG. 5*a* through FIG. 5*d*, the die set 15, which can be used in the press 1 which is provided with the upper cushion means 11 and the lower cushion means 13, comprises a base plate 109, a lower die 115 and an upper die 117. Namely, the base plate 109 is fixed on a base 107 which is in turn fixed on the bolster 9. The base plate 109 is provided with a plurality of upright guide posts 111 by which in turn an upper plate 113 is vertically movably guided. The lower die 115 which is used for forming a plate-like workpiece is mounted on the top surface of the base plate 109, and the upper die 117 which opposes the lower die 115 is mounted on the bottom surface of the upper plate 113.

In order to form the inner side of the workpiece, at the central portion of the top surface of the base plate 109, there is fixedly provided a cylindrically shaped die support 121 which integrally supports a male die 119 having its top portion of a shape substantially complementary to the inner shape of the workpiece to be processed. This male die 119 is formed with a die hole 123 at its center. Further, the male die 119 and the die support 121 are formed with a proper number of longitudinal recesses 125 along the outer periphery thereof. Vertically movably fitted to the outer periphery of the die support 121 is a ring-like first annular body 127 which has a projection 129 extending into the recess 125 and projecting upwardly. The projection 127 is formed with a die hole 131 in the top surface thereof. The first annular body 127 is supported by a plurality of first vertically movable rods 133 on the top end thereof which can move up and down through the base plate 109. The lower end of each of the first vertically movable rods 133 is supported by a first vertically movable pad 135 of a disc shape which is supported by the cushion pins CP3 passing through the bolster 9 and the bed 7 and supported by the cushion pad 73 of the lower cushion means 13. Therefore, the first annular body 127 is always biased upwardly, and in the normal condition, the top surface of the projection 129 is substantially flush with the top surface of the male die 119.

At the outside of the first annular body 127, a cylindrical second annular body 137 is mounted vertically movably. The second annular body 137 is supported by a plurality of second vertically movable rods 139 which are similar to the first vertically movable rods 133. The second vertically movable rods 139 are supported by an annular second vertically movable pad 141 surrounding the first vertically movable pad 135. The second vertically movable pad 141 is supported by the cushion pins CP4 which are similar to the cushion pins CP3 and supported by the cushion pad 83 of the lower cushion means 13. Therefore, the second annular body 137 is always biased upwardly, and in the normal condition, its top surface is substantially flush with the top surface of the male die 119. At the outside of the second annular body 137, an annular guide body 143 is mounted with its top surface being substantially flush with the top surface of the male die 119.

The upper plate 113 is mounted integrally with the bottom surface of the slide 5 so as to move up and down together with the slide 5. At the central portion of the bottom surface of the upper plate 113, a disc like punch holder 149 is mounted to support a depending punch 145 opposing the die hole 123 of the lower die 115 and a depending punch 147 opposing the die hole 131.

Below the punch holder 149, a disc like female die 151 is disposed vertically movably and has a bottom surface formed in correspondence with the shape of the top surface of the male die 119. The female die 151 has a central hole through which the punch can extend and also is integrally connected to the lower ends of the third vertically movable rods 153 which can move up and down through the upper plate 113. The upper end of the vertically movable rod 153 is connected to the cushion pin CP2, the upper end of which can be in abutting engagement with the lower end of the piston rod 27 of the second piston 25 in the upper cushion means 11.

Vertically movably disposed between the female die 151 and the punch holder 149 is a vertically movable body 155 of a disc shape which has holes allowing the punches 145, 147 to pass therethrough. From a plurality of portions of the bottom surface of the vertically movable body 155, tubular projections 157 depend so as to oppose the projections 129 of the lower die 115. The bottom surfaces of these projections are, in the normal condition, substantially flush with the bottom surface of the female die 151, and the punch 147 is disposed within the projection 157. The vertically movable body 155 is integrally connected with the cushion pins CP1 at the lower end thereof which pass vertically through the upper plate 113. The upper end of the cushion pin CP1 can be in abutting engagement with the bottom surface of the first piston 21 of the upper cushion means 11.

A stepped cylindrical drawing die 161, disposed outside of the punch holder 149 and the vertically movable body 155, is fixed to the bottom surface of the upper plate 113. The inside diameter of the lower portion of the drawing die 161 is formed slightly larger than the diameter of the male die 119, and its outside diameter is formed approximately the same to the outside diameter of the second annular body 137. The lower end surface of the drawing die 161 opposes the upper end portion of the second annular body 137, and in the normal condition, is substantially flush with the bottom surface of the female die 151.

At the outside of the drawing die 161, an annular plate holder 163 is disposed vertically movably. The plate holder 163 is integrally held by a plurality of bolts at the lower end thereof (not shown) which pass vertically through the upper plate. The plate holder 163 is always biased downwardly by a resilient member such as a coil spring resiliently mounted between the plate holder 163 and the upper plate 113, and its bottom surface, in the normal condition, is positioned slightly below the bottom surface of the female die 151.

Figure 5A:
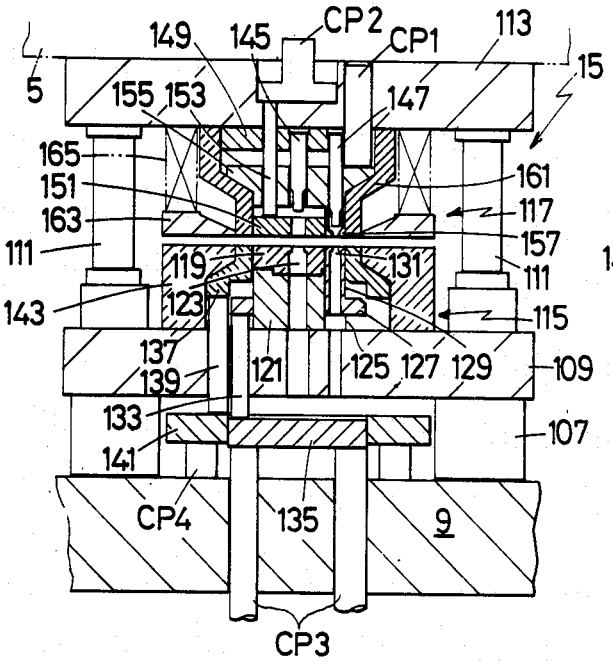
FIGS. 5*a*, 5*b*, 5*c* and 5*d* are vertical sectional views of a die set of a tool for the press shown in FIG. 1 showing actions of the tool.
Figure 5B:
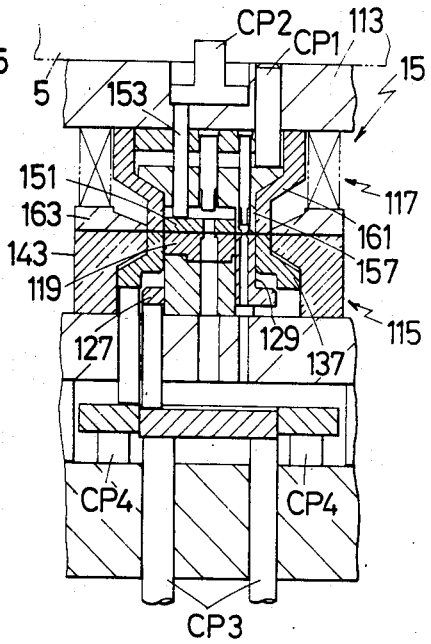

In operation, when the slide 5 of the press 1 is lowered after the energizing of proper solenoids and the positioning of a plate like workpiece on the lower die 115, the upper plate 113 will be lowered integrally with the slide 5. Then, firstly, the plate holder 163 of the upper die 117 presses the workpiece against the guide body 143 of the lower die 115. Namely, as shown in FIG. 5*b*, the workpiece is pinched between the lower die 115 and the upper die 117. Thus, the workpiece is pinched between the drawings die 161 and the second annular body 137, and between the upper and lower projections 157 and 129. Also, the workpiece is pinched between the bottom surface of the female die 151 and the top surface of the male die 119, and thus the top surface of the workpiece can be formed. At this time, due to downward movement of the slide 5 and the upper plate 113, the third vertically movable rod 153, the cushion pin CP2 and the second piston 25 will relatively move up. Therefore, the pressure inside the second chamber 23*c* of the upper cushion means 11 will gradually rise, and when it becomes higher than the pressure in the amplifying chamber 99*a* of the booster 99, the piston 99*p* of the booster 99 is moved to the left with reference to FIG. 4, and thus oil is returned to the tank 105.

Figure 5C:
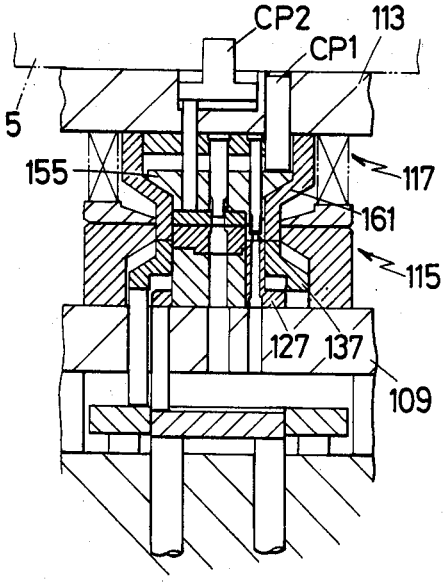

When the slide 5 and the upper plate 113 further descend from the state shown in FIG. 5*b*, the vertically movable body 155 and the drawing die 161 of the upper die further lower the first annular body 127 and the second annular body 137, which results in the state as shown in FIG. 5*c*, effecting trimming and drawing process. At this time, the pressure inside the first chamber 19*c* of the upper cushion means 11 and the pressure inside the third chamber 59*c* of the lower cushion means 13 gradually increase. However, by presetting the setting pressure of the relief valve RFV1 higher than the setting pressure of the relief valve RFV2, the first annular body 127 will gradually be lowered. Therefore, the workpiece is drawn without causing wrinkles.

As set forth above, when the first annular body 127 of the lower die 115 gradually descends and when it comes to a stop by abutting the base plate 109 as shown in FIG. 5*c*, if the second and seventh solenoid valves SOL2, SOL7 are opened (as shown in FIG. 4), since the pressure inside the first chamber 19*c* and the third chamber 59*c* rapidly decreases, the force required for lowering the slide will decrease.

Figure 5D:
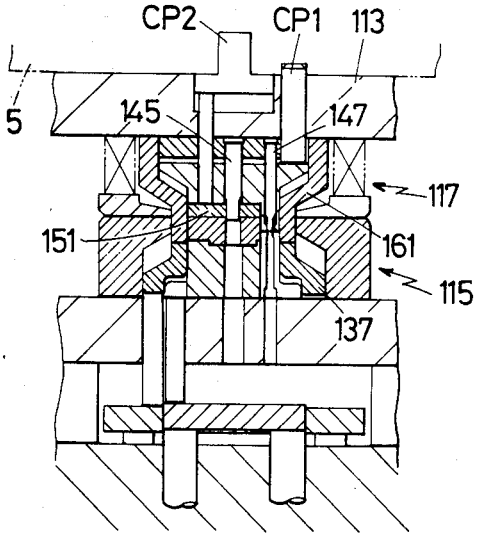

As the slide 5 and the upper plate 113 further descend from the state shown in FIG. 5*c*, the second annular body 137 of the lower die 105 and the drawing die 161 of the upper die 117 are lowered with the work piece supported therebetween as shown in FIG. 5*d*, and a piercing process is performed by the punches 145, 147 of the upper die 117 approximately simultaneously with a deep drawing process around the workpiece without causing any wrinkles. Thereafter, the slide 5 moves past the lower dead point and is raised, by which the upper plate 113 is also raised. At this time, the product processed which is fitted into the drawing die 161 will be raised together with the drawing die. Therefore, when the slide 5 has been raised to a suitable point, for instance, when it has reached near the upper dead point, if the fourth solenoid valve SOL4 in FIG. 4 is energized to be open, the high pressure in the booster 99 will be supplied to the second chamber 23*c*, and thus the female die 151 will be projected and will knock out the product from the drawing die 161.

Figure 6:
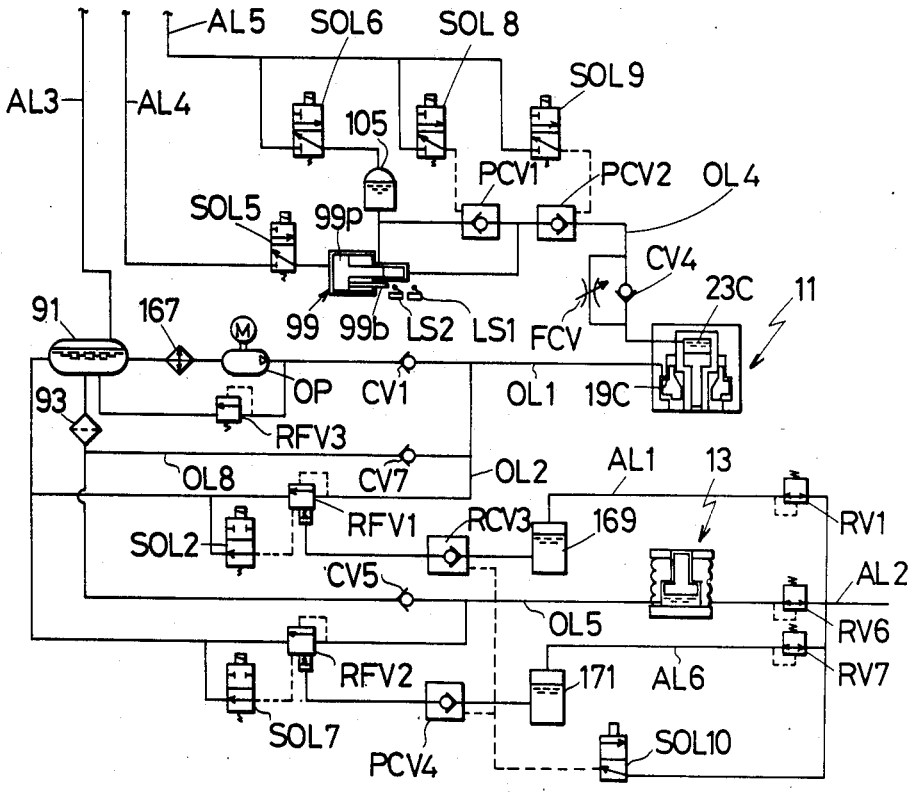
FIG. 6 is a schematic illustration of a pneumatic hydraulic control circuit of a second embodiment of the present invention.

Referring now to FIG. 6, a second embodiment of the pneumatic hydraulic control circuit for controlling the upper cushion means 11 and the lower cushion means 13 is shown, wherein like numerals designate previously described elements in the first embodiment in FIG. 4, and the details thereof will not be described.

In the second embodiment, in order to provide the stabilized replenishment of oil into the pressure amplifying chamber 99*a* of the booster 99 and the pressure control of the second chamber 23*c* of the upper cushion means 11, pilot operated check valves PCVl and PCV2 are opposingly provided in a fourth oil line OL4. In the fifth air line AL5 there are connected eighth and ninth solenoid valves SOL8, SOL9 for operating the pilot operated check valves PCVl, PCV2, respectively. Also, in order to detect whether the amount of oil inside the booster 99 is insufficient or sufficient, there is installed an actuating rod 99*b* integrally with the piston 99*p* of the booster 99 for actuating limit switches LS1, LS2. Thus by energizing the solenoid valves SOL5, SOL6, SOL8 and SOL9 properly as required, and thereby controlling the pilot operated check valves PCVl, PCV2 properly, the replenishment of oil into the booster 99 and the pressure control inside the second chamber 23c of the upper cushion means 11 can be achieved. For instance, when the solenoid valve SOL 8 is energized, the pressure inside the second chamber 23c will be the same to the pressure inside the tank 105, and when the solenoid valve SOL9 is energized, the high pressure oil in the booster 99 can be supplied to the second chamber 23c.

Referring further to FIG. 6, in order to apply a relatively high pressure to the first chamber 19c of the upper cushion means 11, an oil pump OP connected to the oil tank 91 through a cooler 167 and a relief valve RFV3 are arranged in the oil line OL1. Also an oil line OL8 arranged with a check valve CV7 is connected in parallel to the oil pump OP, etc. Thus, a large volume of hydraulic oil of relatively low pressure can be supplied to the first chamber 19c of the upper cushion means 11 from the oil tank 91 through the oil line OL8 and, by oil pump OP, a relatively high pressure can be maintained in the first chamber 19c. Therefore, the oil pump OP can be a small pump of high pressure and low discharge which is inexpensive in production cost, and the pressure inside the first chamber 19c of the upper cushion means 11 can be raised rapidly to a required pressure, which attributes the good quality of products finished during the drawing process.

Referring to FIG. 6 again, in order to render more definite control of first and second relief valves RFV1 and RFV2, in place of the pneumatically operated control cylinders CY1 and CY2, check valves PCV3 and PCV4 for pilot control are connected to the first and second relief valves RFV1 and RFV2 respectively. Each of the check vales PCV3, PCV4 is connected to oil tanks 169, 171 installed in the first and sixth air lines AL1 and AL6, respectively. Also a solenoid valve SOL 10 is connected to the check valves PCV3, PCV4 for pilot shifting. Namely, each of the relief valves RFV1, RFV2 is controlled by hydraulic pressure and maintained at a control pressure by the check valves PCV3, PCV4. Therefore, it is not necessary to give consideration to compressibility of working fluid as in the case of pneumatic pressure, and thus more precise control of the relief valves RFV1, RFV2 is provided, which will improve the accuracy of the process.

As can be understood from the embodiments as described above, according to the present invention, even when the product is of a varied shape which requires a multiplestep process, such a process can be accomplished in one stroke of the press slide. Since the pressure source of the upper and lower cushion means is given by the pneumatic hydraulic control circuit, the construction is compact and can be made at a lowcost. Further, since the setting of the hydraulic pressure inside each cushion means can be made freely, optimum conditions thereof can be selected according to materials, etc. of the workpiece.

Also, due to the pneumatic hydraulic control circuit provided with a smooth knockout function, a smooth knock out process can be accomplished.

Further, since the initial processing pressure can be set properly, finishing accuracy of the product is improved.

Moreover, the accuracy of the product is improved due to the relief valves which can maintain pressure accurately at a required value during a gradual increase of pressure depending on the working process.

What is claimed is:

1. A press for performing more than one forming process on a workpiece in one stroke of said press comprised:

a frame, a bed fixed to said frame, a slide movable mounted on said frame above said bed and movable on said frame toward and away from said bed, a first multi-function die means mounted on said bed, a second multi-function die means mounted on said slide, said first die means having a plurality of movable dies, said second die means having plurality of movable dies aligned and cooperating with said movable dies on said first die means, at the opposite surfaces of a workpiece positioned between said first and second die, means for die forming said workpiece when said press is operated and said slide on said frame is moved toward said bed, said first and second die means having opposed surfaces for engaging and holding the workpiece between said first and said second die means when said slide is moved toward said bed and said first and said second die means engage the opposite surfaces of the workpiece, fluid pressure actuated means on said bed and on said slide for engaging said dies of said plurality of movable dies on said first and said second die means and for selectively actuating said dies, means for applying fluid pressure at a preselected pressures to said fluid pressure actuated to selected ones of said dies for engaging said opposite surfaces of said workpiece, means intermediate said first and said second die means and said bed and said slide for permitting said slide to move toward said bed after said first and said second die means engage the oppositie sides of the workpiece and said dies of said plurality of movable dies on said first and said second die means are actuated by said fluid pressure actuated means to die form said workpiece held between said dies and means for releasing fluid pressure from said fluid pressure actuated means when said pressure exceeds said preselected fluid pressure.

2. A press as in claim 1, wherein one of said dies of said plurality of dies of one of said first and second die means is a knock-out means a said means for applying fluid pressure includes a pilot operated check valve for controlling the knock-out function of said knock-out means.

3. A press as in claim 2 wherein said means for applying fluid pressure includes a pressure pump for applying fluid pressure at selected pressures for selectively actuating said dies.

4. A press as in claim 2 wherein said means for applying fluid pressure includes a plurality of relief valves each for controlling said preselected pressure applied to the selected ones of said dies and a pneumatically pressured controlled surge tank and control means for separately controlling the pressure of each said relief valve through the hydraulic pressure of said surge tank.

* * * * *